US005598172A

United States Patent [19]

Chekroun

[11] Patent Number: 5,598,172

[45] Date of Patent: Jan. 28, 1997

[54] DUAL-POLARIZATION MICROWAVE LENS AND ITS APPLICATION TO A PHASED-ARRAY ANTENNA

[75] Inventor: Claude Chekroun, Gif sur Yvette, France

[73] Assignee: Thomson - CSF Radant, Les Ulis, France

[21] Appl. No.: 799,785

[22] Filed: Nov. 5, 1991

[30] Foreign Application Priority Data

Nov. 6, 1990 [FR] France ..... 90 13708

[51] Int. Cl.[6] ..... H01Q 19/06; H01Q 15/02

[52] U.S. Cl. ..... 343/754; 343/756; 343/909

[58] Field of Search ..... 343/754, 756, 343/909, 911 R, 913

[56] References Cited

U.S. PATENT DOCUMENTS

| | | | |
|---|---|---|---|
| 3,569,974 | 3/1971 | McLeod, Jr. | 343/754 |
| 4,212,014 | 7/1980 | Chekroun | 343/754 |
| 4,320,404 | 3/1982 | Chekroun | 343/754 |
| 4,344,077 | 8/1982 | Chekroun et al. | 343/754 |
| 4,447,815 | 5/1984 | Chekroun et al. | 343/754 |
| 4,975,712 | 12/1990 | Chen | 343/754 |
| 5,001,495 | 3/1991 | Chekroun | 343/754 |
| 5,081,465 | 1/1992 | Collignon | 343/754 |

*Primary Examiner*—Gregory C. Issing
*Attorney, Agent, or Firm*—Pollock, Vande Sande & Priddy

[57] ABSTRACT

A microwave lens of the type described in the French patent No. 2,469,808 is adapted to operate with two crossed polarizations. To this end, each of the phase-shifting channels of the lens is subdivided into two subchannels, each of them being assigned to one of said polarizations. Each subchannel includes, in addition to phase-shifting panels, means for rotating by 90° the polarization of the incident wave and impedance matching means.

12 Claims, 8 Drawing Sheets

"PRIOR ART"

"PRIOR ART"

DUAL-POLARIZATION MICROWAVE LENS AND ITS APPLICATION TO A PHASED-ARRAY ANTENNA

BACKGROUND OF THE INVENTION

The present invention relates to a dual-polarization microwave lens, that is, a lens capable of operating with two crossed polarizations. The present invention also relates to the application of such a lens to the construction of a phased-array antenna.

For implementing a phased-array antenna, for instance, it is known to use a microwave lens made up of panels introducing a phase shift of the electromagnetic microwave passing through them. Each of these panels includes wires carrying diodes, parallel to one another. Controlling the ON or OFF state of the diodes allows varying of the phase shift imparted to the incident wave and, as a result, obtaining an "electronic" scanning. Such an antenna is, for example, described in the French patent No. 2,469,808. Its principle is illustrated in FIG. 1*b*, in a schematic manner, in the plane of the electric field.

In FIG. 1*a*, there is shown three superposed panels, i.e., located in a single plane, designated by $P_1$, $P_2$ and $P_3$. Each of the panels comprises a dielectric support 1 on which parallel wires 2 carrying diodes 3 are disposed. The diode-carrying wires 2 are connected by conductors 7 which are substantially perpendicular to them and are used for controlling the state of the diodes : in each of the panels, all diodes are controlled simultaneously and identically by means of the conductors 7 by voltages sufficient to make them conducting or not. The panels are separated and surrounded by conductive plates which are perpendicular to them and denoted by $P_{L1}$, $P_{L2}$, $P_{L3}$, $P_{L4}$.

In FIG. 1*b*, there is shown a plurality of panels such as $P_1$, $P_2$, $P_3$, denoted here by P, disposed in the channels formed by the plates, denoted here by $P_L$, taken two by two. The set of panels P in a single channel forms a phase shifter ($D_1$, $D_2$, $D_3$, . . . ). The slack formed by a plurality of phase shifters constitutes an active microwave lens which is illuminated by a source S (FIG. 1*a*), the latter transmitting an electromagnetic wave whose electric field (or polarization) E is perpendicular to the plates $P_L$. As an example, there is shown in FIG. 1*b* the direction of propagation 10 of an incident wave, and a transmitted wave whose direction 20 is deflected with respect to the incident wave.

The panels P being controlled independently of one another, it appears that the phase shift they impart to the wave passing through them can be different from one panel to the next. By joining one behind the other a plurality of panels in a single channel along the path of the microwave, it can be seen that phase shifts from 0 ° to 360° can be obtained by increments whose value is related to the number of joined panels. By stacking a plurality of such phase shifters, it is thus possible to implement an electronic scanning in a plane parallel to the electric field E.

Furthermore, in certain applications, it is necessary to be able to have a single antenna operate with two crossed polarizations, i.e., the antenna, or the lens, must be capable of operating with an electromagnetic wave whose electric field is directed along a first given direction, as well as with a wave whose electric field is directed along a direction perpendicular to the preceding one. Such antennas have applications in particular in the fields of antijamming, improvement of target detection and recognition, as well as very-low-altitude flight.

SUMMARY OF THE INVENTION

An object of the present invention is a microwave lens of the type described in the aforementioned French patent, that adapted to is operate operating with two crossed polarizations.

More specifically, according to the invention, each of the above phase-shifting panels is subdivided into two subchannels whose height is lower than or equal to $\lambda/2$ and which are respectively assigned to the two polarizations. Inside each subchannel, there are, in addition to the phase shifting panels:

rotation means for rotating by 90° the polarization of the incident wave; and impedance matching means.

BRIEF DESCRIPTION OF THE DRAWINGS

Other objects, features and advantages of the present invention will become apparent from the following detailed description of preferred embodiments given as a non-limitative example with reference to the accompanying drawings, in which.

In these various Figures, like reference numerals denote like elements.

Furthermore, for the sake of simplicity, the description of the antenna using the lens of the invention will be given for the transmission mode of operation, it being understood that the antenna operates, in a conventional way, also in the reception mode.

DESCRIPTION OF THE PREFERRED EMBODIMENTS

Figure 2:
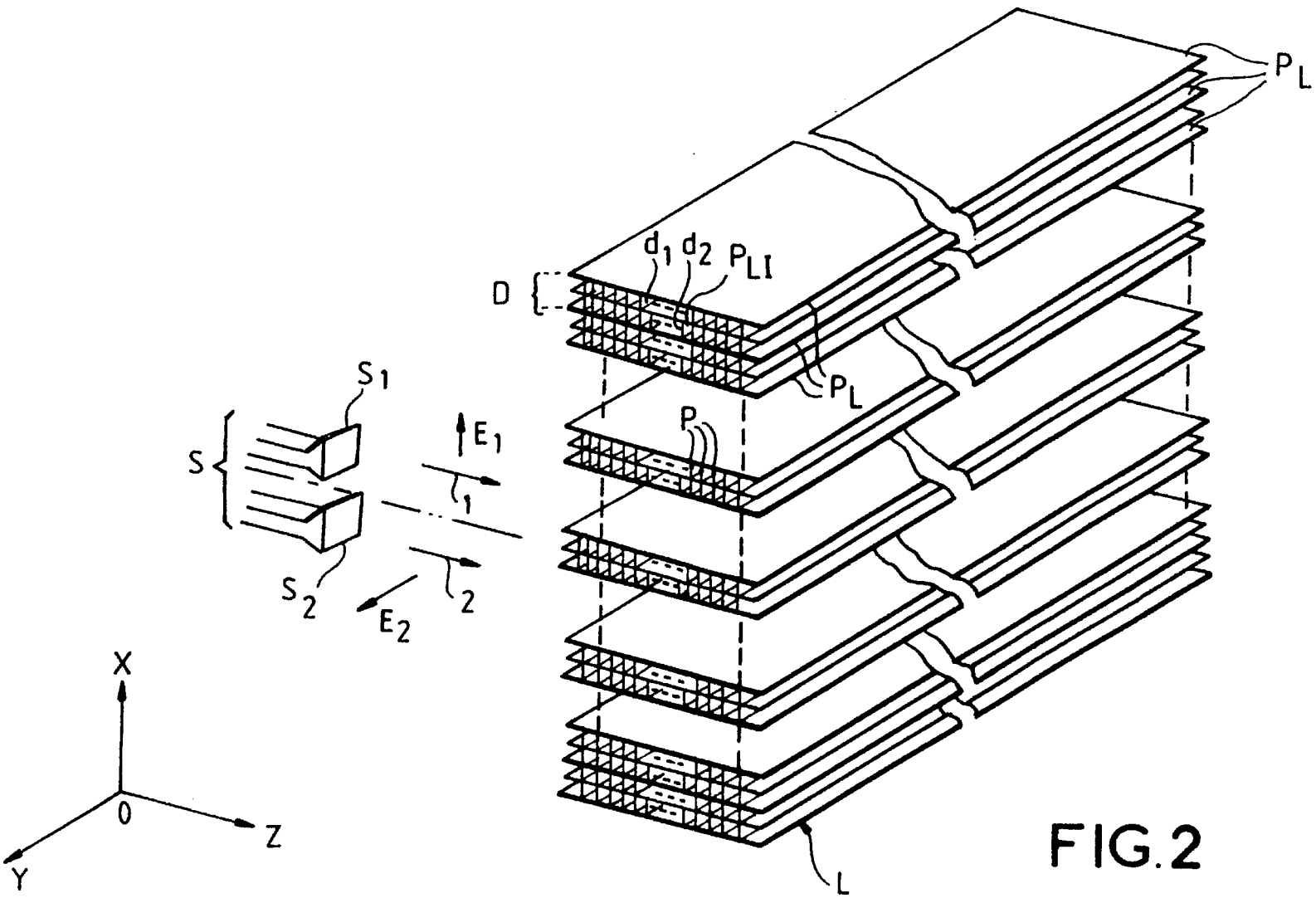
FIG. 2 is a schematic general view of a particular embodiment of the dual-polarization antenna according to the invention.

Referring to FIG. 2, there is shown a schematic general view of an embodiment of the dual-polarization antenna according to the invention.

This antenna comprises a microwave lens L illuminated by means S for transmitting/receiving microwave electromagnetic energy, also called a source.

The source S accomplishes the transmission/reception of a first microwave, schematically represented by an arrow 1, propagating in a direction OZ and whose polarization, illustrated by the wave electric field vector denoted by $E_1$, is parallel to a direction OX normal to the preceding one. The source S also accomplishes the transmission/reception of a second microwave, symbolized by an arrow 2, in the same direction OZ, but whose polarization, symbolized by the wave electric field vector $E_2$, is parallel to an axis OY, perpendicular to both preceding axes. The transmission of the waves 1 and 2 is achievable by any known means. In the embodiment illustrated in FIG. 2, these means are two horns $S_1$ and $S_2$, respectively transmitting the waves 1 and 2.

Figure 1A:
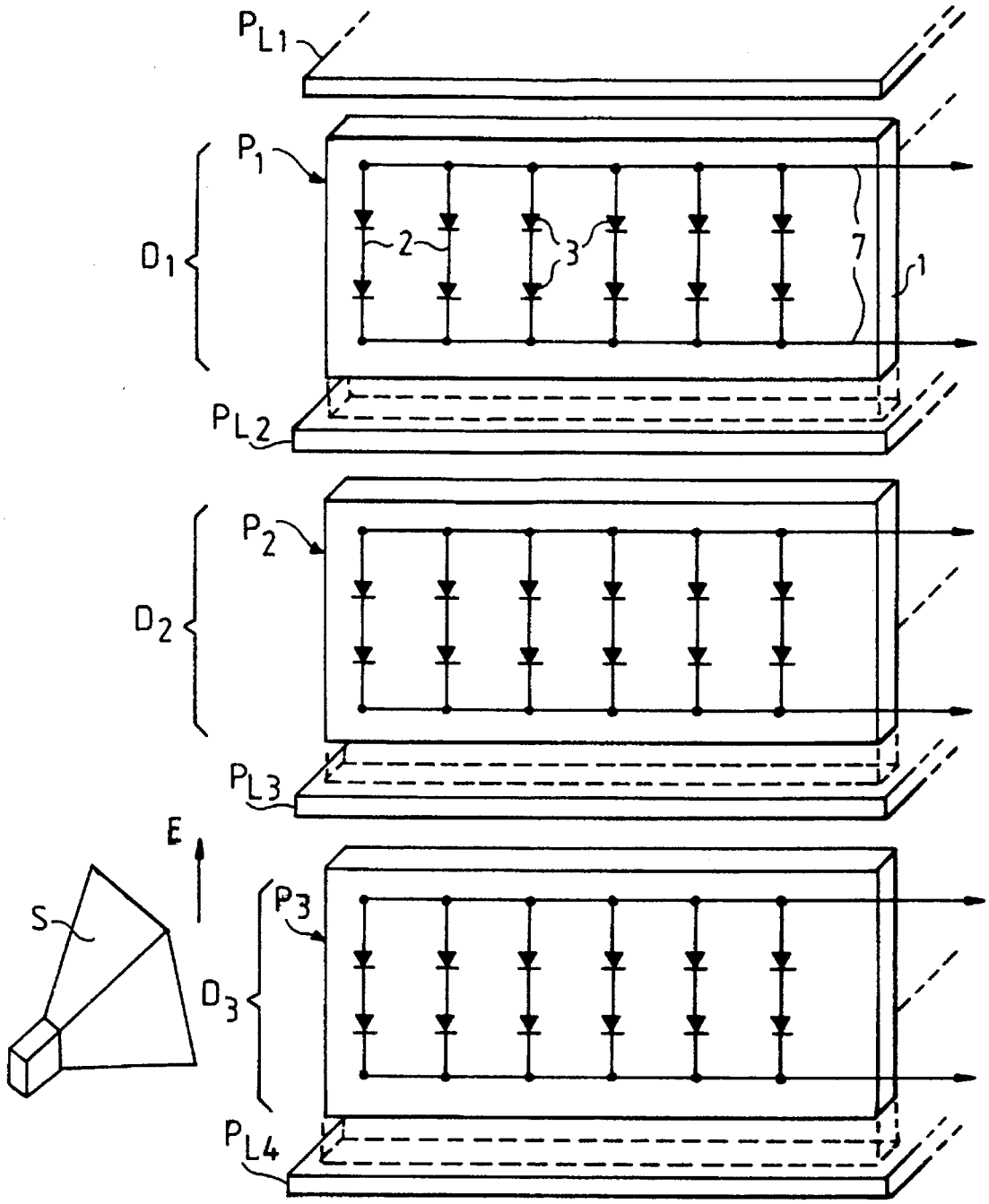
FIGS. 1*a* and 1*b*, already described, are schematic diagrams of the device according to the abovementioned French patent.
Figure 1B:
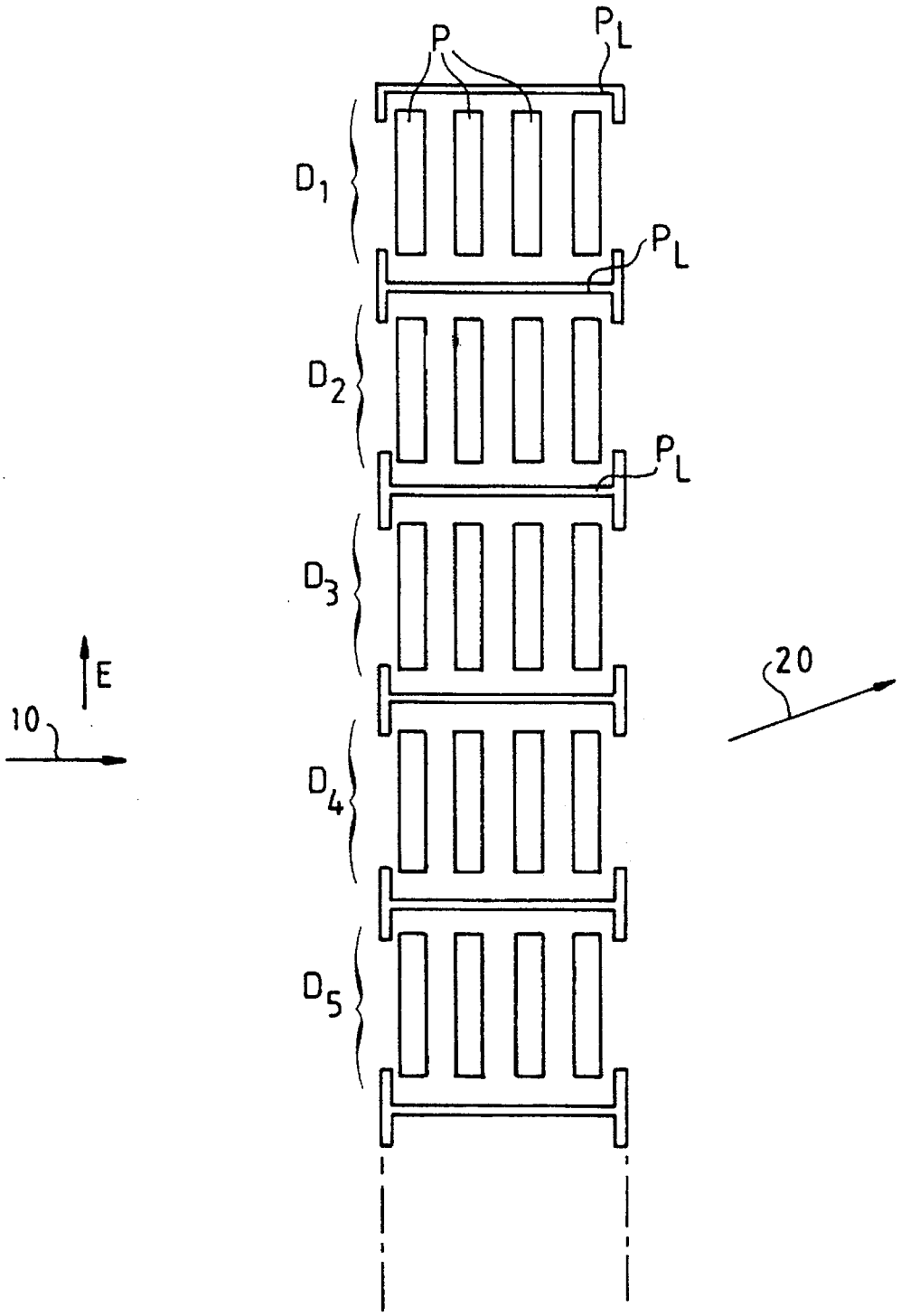

The lens L is implemented in a manner similar to what is shown in FIGS. 1*a* and 1*b*, except that each of the phase-shifting channels D is divided into two subchannels denoted by $d_1$ and $d_2$.

More specifically, the lens L comprises a stack, along the axis OX, of phase-shifting channels D separated by conductive plates $P_L$ parallel to the plane YOZ and spaced substantially by $\lambda/2$, where $\lambda$ is the operating wavelength of the lens. The phase-shifting panels P are disposed, in the channels, parallel to the plane XOY.

Between the two plates $P_L$ delimiting the channel D, there is disposed a third conductive plate $P_{LI}$ called intermediate plate, parallel to both preceding plates. The plate $P_{LI}$ may or not be disposed halfway between the plates $P_L$. Each of the subchannels $d_1$ and $d_2$ is then delimited by one of the plates $P_L$ and the intermediate plate $P_{LI}$.

Figure 3:
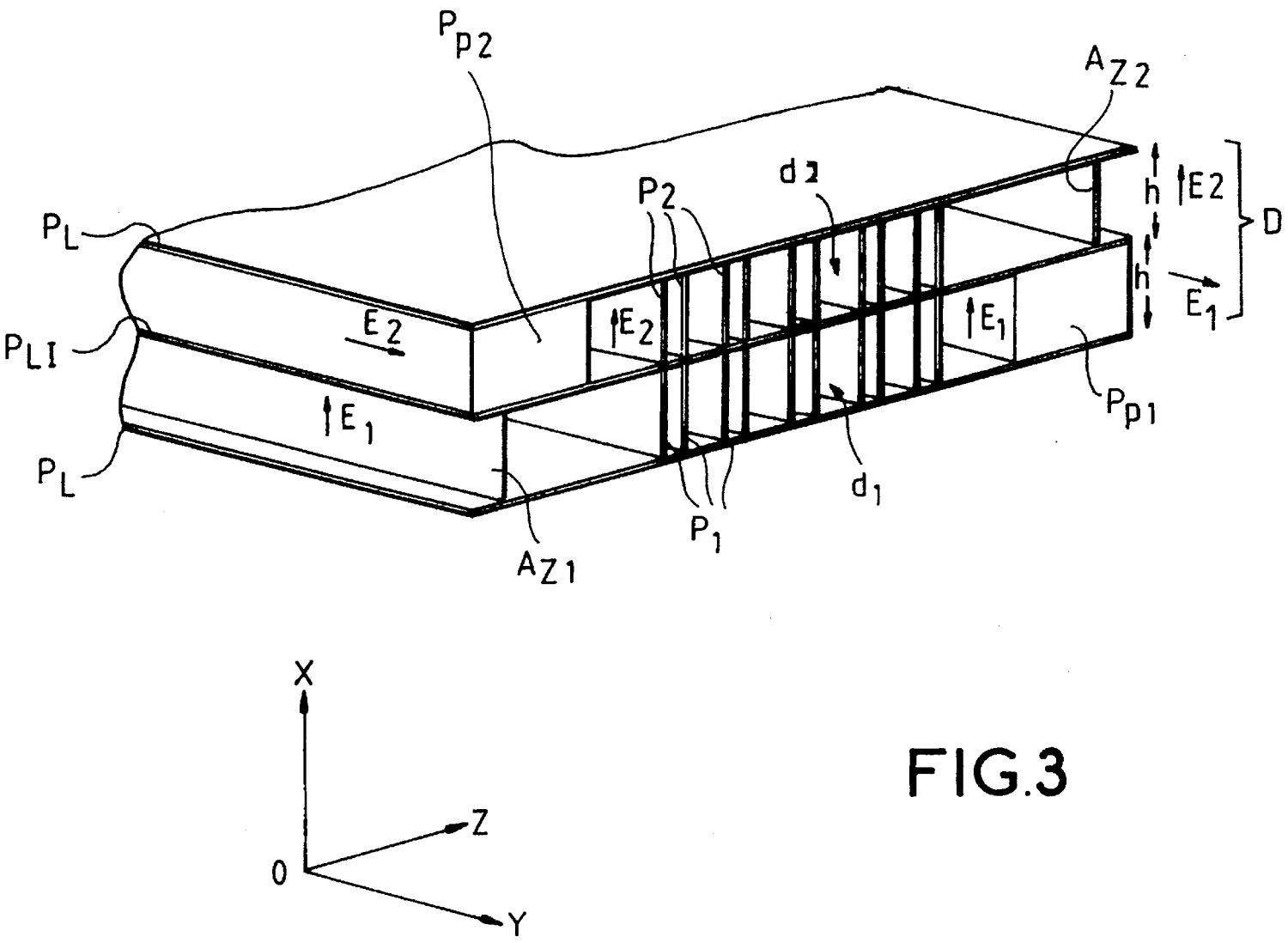
FIG. 3 shows a particular embodiment of a phase shifting channel used in the structure of FIG. 2.

Referring to FIG. 3, there is shown in a more detailed manner an embodiment of one of the phase shifting channels D of FIG. 2.

Within each of the subchannels $d_1$ and $d_2$ there is disposed a plurality of phase-shifting cells, each formed of several phase-shifting panels (respectively denoted by $P_1$ and $P_2$ for he subchannels $d_1$ and $d_2$), one behind the other along the path of the microwave. By way of example, if it is desired to obtain a phase shift value expressed with 5 bits, the succession of phase-shifting cells in a single subchannel is the following :

cell no. 1: 180°-phase shift;

cell no. 2: 90°-phase shift.;

cell no. 3: 45°-phase shift;

cell no. 4: 22.5°-phase shift;

cell no. 5: 12.25°-phase shift.

The channel $d_1$ thus includes a plurality of panels $P_1$ which allows implement the cells no. 2 through 5, followed by a device $P_{P1}$ producing the 180°-phase shift (cell no. 1) as well as the 90°-rotation of the polarization of the wave it receives. The device $P_{P1}$ is thus disposed at one end of the subchannel (right-hand end in the example of the FIG.). This subchannel $d_1$ includes in addition impedance matching means at both ends. In the Figure, $A_{Z1}$ denotes the impedance matching means disposed at the end opposite the device $P_{P1}$. At the other end, these matching means are, in this embodiment, integrated into the device $P_{P1}$.

The subchannel $d_2$ is constituted in the same manner as the subchannel $d_1$ but the disposition of the elements is reversed with respect to the latter, i.e., there is successively a device $P_{P2}$ similar to the device $P_{P1}$ producing a 180°-phase shift and a rotation of polarization, then the panels $P_2$ forming the cells no. 2 through 5, and finally the impedance matching means $A_{Z2}$. It thus appears that the device $P_{P2}$ is disposed at an end opposite to that of the device $P_{P1}$.

The devices $P_{P1}$ and $P_{P2}$ may be implemented by any known means producing :

a 180°-phase shift of the wave passing through them, on command;

a 90°-rotation of the polarization of the wave passing through them; and

Impedance matching to avoid that the these devices induce spurious reflections of the wave passing through them.

As an example, the 180°-phase shift can be accomplished by phase-shifting panels P, and the rotation of the polarization by a set of panels such as those described in the article entitled "Broad-Band Wide-Angle quasi-Optical Polarization Rotators" by Noach Amitay and Adel A. M. Saleh (published in IEEE Transactions on Antennas and Propagation, Vol. AP-31, No. 1, January 1983), the set of panels being dimensioned in accordance with known techniques so as to be impedance-matched.

In operation, the lens L is illuminated by the two waves 1 and 2 with cross-polarization, simultaneously or not.

The wave 1, with the polarization $E_1$ parallel to OX, can propagate in the subchannel $d_1$. It successively encounters therein the impedance matching means $A_{Z1}$, the phase-shifting cells No. 2 through 5, then the device $P_{P1}$ that imparts to it or not, on command, a 180° -phase shift and causes a 90°-rotation of its polarization. The wave emerging from the subchannel $d_1$ has thus its electric field $E_1$ now parallel to the direction OY.

The wave 2, whose electric field $E_2$ is parallel to the plates $P_L$ and $P_{LI}$ cannot propagate in the subchannels $d_1$and $d_2$ without special precautions. As a matter of fact, it is well known that a microwave can propagate between two plates forming a waveguide only if the distance h between the two plates is greater than $\lambda/2$. Now, here h is approximately equal to $\lambda/4$ (if the plate $P_{LI}$ is disposed in the middle of the channel D). There is then disposed in the subchannel $d_2$ where the wave 2 is desired to propagate, a filling dielectric material whose dielectric constant $\epsilon_1$, higher than that of air (close to 1), is such that it allows the propagation of a wave. As a matter of fact, as is well known, the wavelength in such a medium becomes, for a propagation of the guided type, that is, when the electric field E is parallel to the plates:

$$\lambda_{G1} = \lambda / \sqrt{\epsilon_1 - (\lambda/2h)^2} \quad (1)$$

By way of example, it is possible to use as a filling material a polyurethane or equivalent foam whose dielectric constant ($\epsilon_1$) is of about 2.2.

In this way, the wave 2 can propagate in the subchannel $d_2$ and only therein. The wave 2 then may undergo under the action of the device $P_{P2}$ a 180°-phase shift and has its polarization rotated by 90°so as to become parallel to OX. The wave then propagates through the various phase-shifting panels $P_2$ of the various cells 2 through 5, up to the impedance matching means $A_{Z2}$ and emerges from the subchannel $d_2$ with a polarization $E_2$ parallel to OX.

In should be noted that the dielectric filling material is limited to the device $P_{P2}$ only. As a matter of fact, the field $E_2$ of the wave 2 being, after this device $P_{P2}$ perpendicular to the plates $P_L$ and $P_{LI}$ the wave 2 can then propagate in the channel $d_2$ without the presence of the dielectric material. In addition, the wave 1, whose electric field $E_1$ is perpendicular to the plates, can propagate in the channel $d_2$ : it passes through the device $P_{P2}$ which produces a rotation of its electric field $E_1$, the latter becoming parallel to the plates. The dielectric material being limited to the device $P_{P2}$ the wave 1 cannot propagate further in the subchannel $d_2$.

The subchannels $d_1$ and $d_2$ are thus assigned to the waves 1 and 2, respectively, with an excellent decoupling (of at least 70 dB).

In addition, the fact to implement the two subchannels by means of similar elements (even disposed in a reverse manner) allows using a single diode control circuit for both subchannels.

Figure 4A:
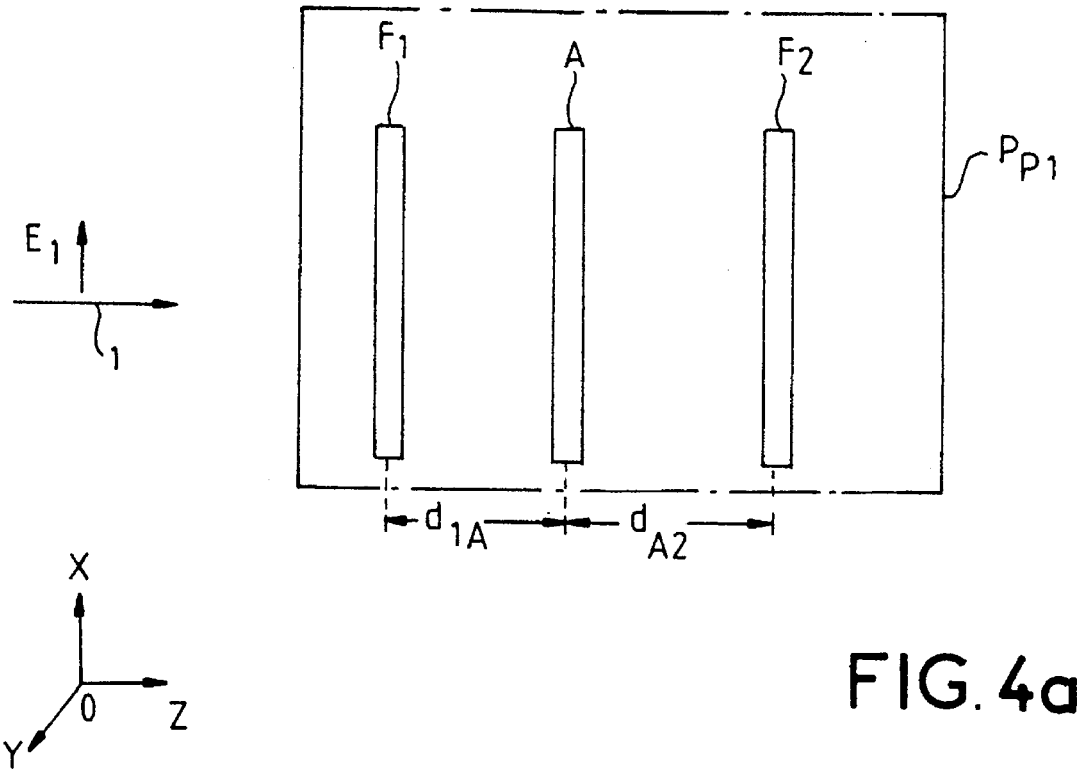
FIGS. 4*a* and 4*b* are schematic diagrams illustrating the structure and the operation of an embodiment of the phase shifting means used in the channel of FIG. 3.
Figure 4B:
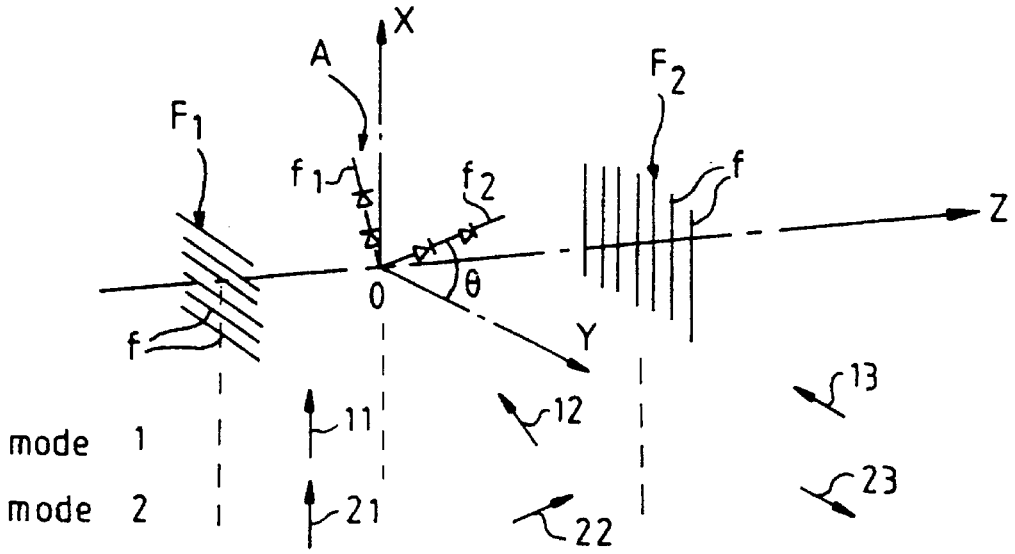

The antenna shown in FIGS. 2 and 3 allows therefore the transmission, simultaneous or not, of two waves (1 and 2), separate and independent, each having a linear polarization normal to that of the other. FIGS. 4*a* and 4*b* are schematic diagrams illustrating the structure and the operation of an embodiment of the phase-shifting device $P_{P1}$ used in the channel of the foregoing Figure, it being understood that the device $P_{P2}$ can advantageously be implemented in a similar manner.

This device is formed by a set of three panels denoted by $F_1$, A and $F_2$. These panels are disposed substantially parallel to one another and successively along the path of the microwave 1. More specifically, the panels are substantially normal to the axis OZ of propagation of the wave, whose electric field $E_1$ is parallel to the axis OX. The panel A is separated from the panel $F_1$ by a distance $d_{1A}$, and from the panel $F_2$ by a distance $d_{A2}$.

Figure 5:
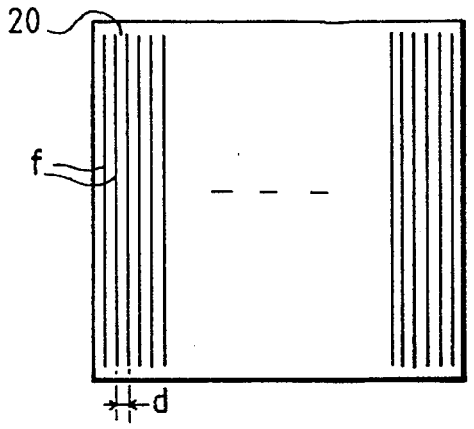
FIGS. 5, 6*a*, 6*b*, and 7*a* through 7*d*, are schematic diagrams of panels used in the phase shifter of FIGS. 4*a* and 4*b*.

FIG. 5 shows schematically one of the panels $F_1$ or $F_2$.

These panels are passive panels. They each comprise a dielectric support 20 on which an array of conductive wires f, substantially parallel to one another, with a small pitch d, that is, very shorter than λ, about λ/10 to λ/20. The wires f are, for example, printed on the support 20.

For the panel $F_1$, the wires f are substantially parallel to the axis OY whereas, for the panel $F_2$, they are substantially parallel to the axis OX.

Figure 6A:
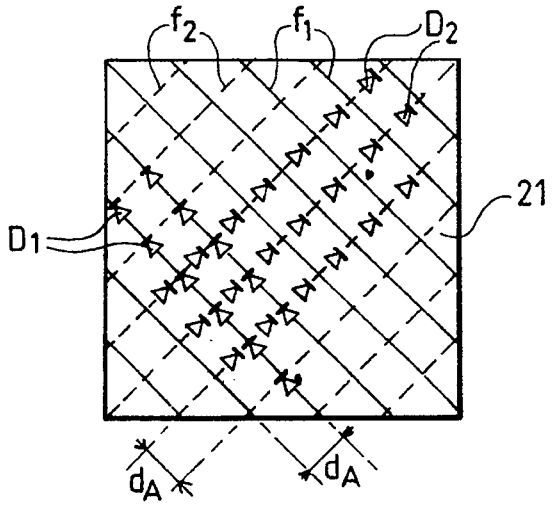

The panel A is a panel formed, as schematically shown in FIG. 6*a*, of two crossed arrays of wires, each carrying diodes.

More specifically, one of the sides of a dielectric support 21 forming the panel carries an array of wires $f_1$, parallel to one another, with a pitch $d_A$, on which the diodes $D_1$ are disposed and connected all in the same direction. On the other side of the support, there is disposed another array of wires denoted by $f_2$ parallel to one another and spaced by a distance $d_A$, carrying diodes $D_2$, also all connected in the same direction. The wires $f_l$ are substantially perpendicular to the wires $f_2$. The distance $d_A$ is in the order of the wavelength, more precisely of λ/2.

Referring to FIG. 4*b*, a schematic diagram used to explain the operation of the device $P_{P1}$ is shown.

The first panel $F_1$ is represented by its wires f parallel to the direction OY, the third panel $F_2$ by its wires f parallel to OX, and the panel A by one of its wires $f_1$ which forms an angle substantially equal to +45° with the axis OX, and one of its wires $f_2$ which forms an angle substantially equal to +45° with the axis OY.

The panels such as $F_1$ and $F_2$ operate in the following manner :

when the electric field of the incident wave is perpendicular to the wires forming the panel, the latter is transparent;

when the electric field is parallel to the wires of the panel, the latter is reflecting.

The panel A operates as follows : when the diodes of one of the arrays of wires, for example the diodes $D_1$ carried by the wires $f_1$, are biased so as to be conducting, the diodes $D_2$ of the other array of wires being biased so as to be in the OFF state, only a microwave whose electric field is parallel to the wires $f_1$ can be transmitted by the panel A. Similarly, when the diodes $D_1$ are in the OFF state and the diodes $D_2$ in the ON state, only a wave whose electric field is parallel to the wires $f_2$ can be transmitted.

The operation of the three panels is summarized in FIG. 4*b*.

In a first mode of operation (mode 1), the electric field $E_1$ of the microwave 1 applied to the device is parallel to 0X. This wave arrow 11 is therefore fully transmitted by the panel $F_1$ in the Figure. In this operating mode, the diodes $D_1$ are biased in the forward direction whereas the diodes $D_2$ are in the OFF state, and consequently only the component of the wave whose polarization (i.e., the electric field) is parallel to the wires $f_1$ can be transmitted by the panel A in the Figure. Finally, the panel $f_2$ functions to impart a supplemental rotation (45°) to the polarization of the wave from the panel A. It transmits only the component of the wave arrow 13 whose polarization is perpendicular to its wires, that is, parallel to OY It thus appears that in this first mode of operation, the polarization of the wave, initially parallel to OX, becomes parallel to OY at the output of the device, and directed toward negative Y (with the signs adopted in the Figure).

In the second mode of operation (mode 2), the diodes $D_2$ are biased in the forward direction and the diodes $D_1$ are in the OFF state. In a similar manner as above, it can be seen that the wave 1, whose electric field $E_1$ is parallel to OX, is transmitted by the panel $F_1$ (arrow 21), that only the component of this wave whose field is parallel to the wires $f_2$ is transmitted by the panel A (arrow 22), and that the wave emerging from the panel $F_2$ (arrow 23) undergoes a supplement rotation of its electric field, which becomes parallel to the axis OY, as previously, but directed toward positive Y.

It thus appears that, depending on the control of the panel A, that is, depending on the direction of the biasing current in the diodes it carries, the emerging wave has its electric field directed toward negative Y : there is thus obtained a relative phase shift of 180° between the operating modes 1 and 2.

It should also be noted that, if the device of the invention receives a linearly polarized microwave whose electric field is parallel to OX, the panel $F_1$ is not useful from this point of view. However, impedance matching means should preferably be provided so as to reduce to the minimum the loss and multiple reflections. The panel $F_1$ may be used for this purpose.

The above-described operation corresponds to the case where the distance between two plates ($P_L$ and $P_{LI}$) delimiting a subchannel is greater than λ/2 so that a wave can propagate therein. When, on the contrary, this distance is approximately equal to or shorter than λ/2, it is known that a wave whose electric field is parallel to the plates cannot propagate in such a structure. According to the present invention, there is then disposed in the structure, at least from the panel A, a filling dielectric material whose dielectric constant $\epsilon_1$ higher than that of air $\epsilon$, close to 1), is such that it allows the propagation of a wave whatever the direction of its electric field. As a matter of fact, as is well known, the wavelength in such a medium becomes : p1 for a propagation of the free-space type, i.e., when the electric field E is parallel to the axis OY :

$$\lambda_1 = \lambda/\sqrt{\epsilon_1} \;;$$

for a propagation of the guided type, i.e., when the electric field E is parallel to the axis OX : $\lambda_{G1}$ given by the above formula (1).

By way of example, it is possible to use as a filling dielectric material a polyurethane or equivalent foam whose dielectric constant $\epsilon_1$ is of about 2.2. Finally, it should be noted that the panels $F_1$ and $F_2$ can be implemented by other means than parallel and closely spaced conductive wires, such as microwave circuits with passive components.

Figure 6B:
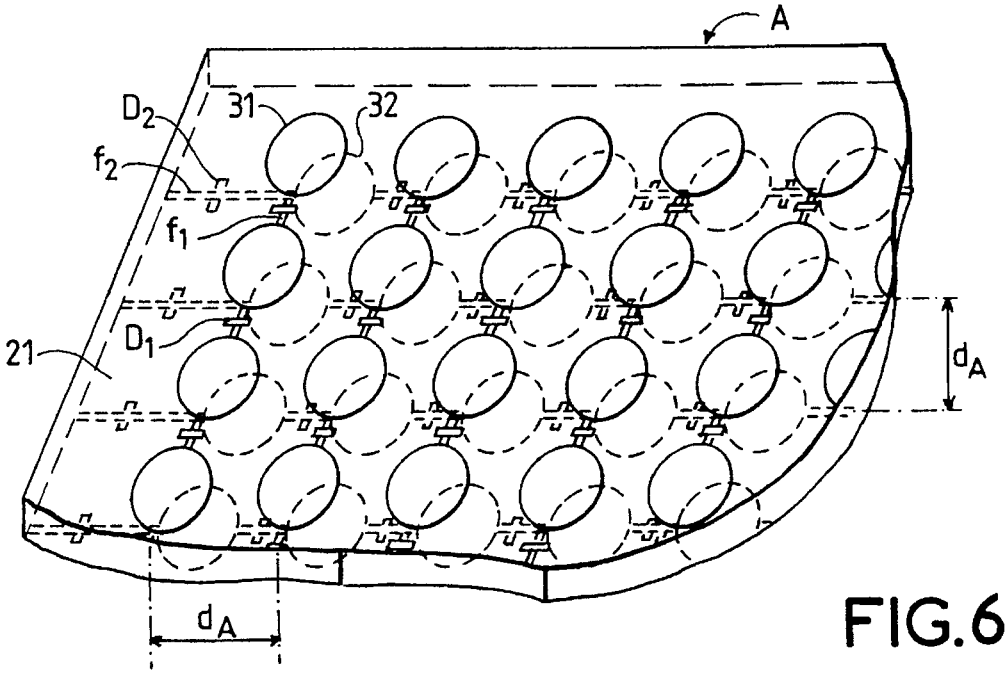

Referring to FIG. 6*b*, a particular embodiment of the panel A used in the above device is shown.

This panel is formed from the dielectric substrate 21 on which are disposed, on each of its sides, substantially circular capacitive pads disposed in rows and columns so that the pads 31 on one of the sides be opposite the pads 32 on the other side. The pads 31 are electrically connected to one another by the conductors $f_l$, and the pads 32 by the conductors $f_2$. In addition, between two pads, diodes $D_1$ and $D_2$ are disposed on the conductors $f_l$ and $f_2$ respectively—a single diode in the example of the Figure.

The pads function to perform the impedance matching of the panel. It should be noted that they are shown in the form of circular disks, but they may have other shapes (rings, surfaces with cutouts, etc.), such a shape being then determined experimentally in view to improve the impedance match of the panel, and similarly for the width of the conductors $f_l$ and $f_2$ the diameter of the pads, and the pitch and characteristics of the diodes.

Referring to FIGS. 7*a* through 7*d*, there is shown a practical embodiment of the panel A adapted to be inserted in a subchannel,the variant of panel A being for example that of FIG. 6*b*.

According to this embodiment, the panel A is made from an insulating substrate 30 made of, for example, a glass-resin laminated material and disposed between the plates $P_L$ and $P_{Ll}$. In holes provided in the substrate 30, diodes $d_1$ and $d_2$ are disposed and attached.

Figure 7A:
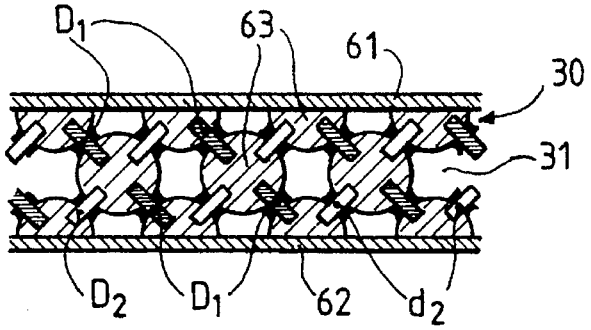

FIG. 7*a* illustrates a First side, 31, or the substrate 30. Appearing on this side are two rows or diodes, alternatively the diodes $d_1$ and $d_2$, attached in the substrate. The side 31 carries disks 63, or half-disks in the vicinity of the plates and staggered. Only the diodes $d_1$ are electrically connected, in a manner not shown, for example by soldering, to these disks 63. The hair-disks 63 are interconnected by conductors 61 (at the top or the diagram) and 62 (at the bottom). To make the drawing clearer, the metallized portions, although not seen in sectional view, have been hachured, as well as the diodes $d_1$ which are connected to them. As compared to the diagram of FIG. 3, the conductors $f_1$ are reduced to a minimum.

Figure 7B:
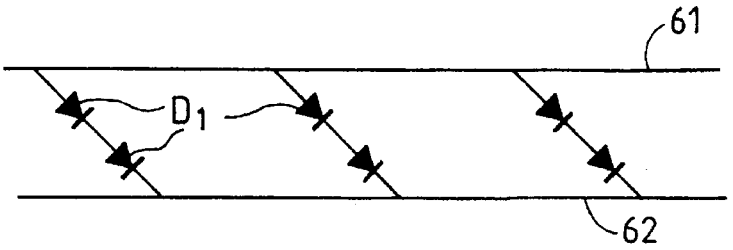

FIG. 7*b* is the electrical diagram of the circuit provided on side 31. It can be seen that the diodes $d_1$ are connected two by two in series, the pairs of diodes being connected in parallel across their biasing connections formed by the conductors 61 and 62.

Figure 7C:
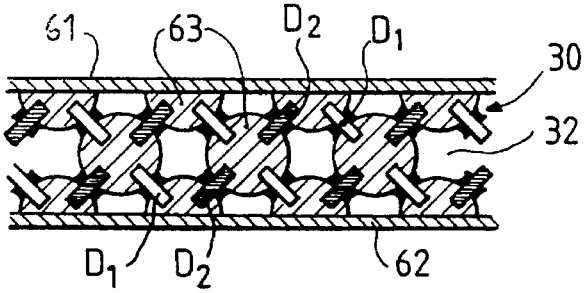

FIG. 7*c* illustrates the other side, denoted by 32, of the substrate 30. The side 32 carries, as the side 31, disks or half-disks 63, staggered and electrically connected to the diodes $d_2$ only and to supply conductors 61 and 62 for the diodes. The various elements are hachured with the same symbols as previously.

Figure 7D:
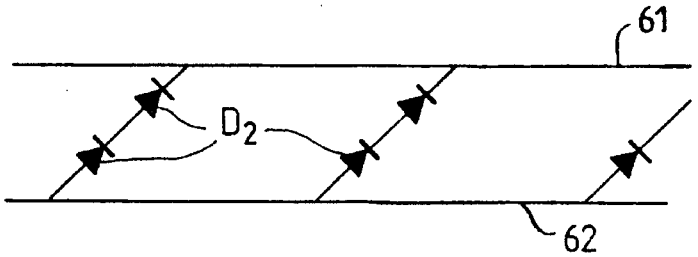

Referring to FIG. 7*d*, the electrical diagram of the circuit on side 32 is shown. It appears that, as for the side 31, the diodes (here $d_2$) are connected two by two in series and in parallel across their biasing connections. Preferably, the latter are also formed by the conductors 61 and 62 and the diodes $d_2$ are connected in the direction opposite to that of the diodes $d_1$. In this manner, a potential difference applied between the two plates in a First direction biases one of the series of diodes (for example $d_1$) in the forward direction and the other series ($d_2$) in the reverse direction, or OFF state. The same potential difference applied in the other direction allows, oppositely, to reverse-bias, or switch OFF, the diodes $d_1$ while biasing the diodes $d_2$ in the forward direction.

It should be noted that when the devices $P_{P1}$ or $P_{P2}$ are implemented as described above with reference to FIGS. 4 through 7, the propagation of the wave $E_1$ is inhibited in the channel $d_2$ (FIG. 3) from the very first panel ($F_1$) of the devices $P_{P2}$, whose wires are parallel to its polarization. In this case, the impedance matching means $A_{Z1}$ of the channel $d_1$ may be implemented, by way of example, as described in the article entitled "Design of corrugated plates for Phased Array Matching" published in IEEE Transactions on Antennas and Propagation, vol. AP-16, No.1, Jan. 1968 (from page 37). The means $A_{Z1}$ are formed by an iris disposed as shown in FIG. 7 of this article, in front of the short-circuit Formed by the panel $F_1$ in the channel $d_2$.

Figure 8:
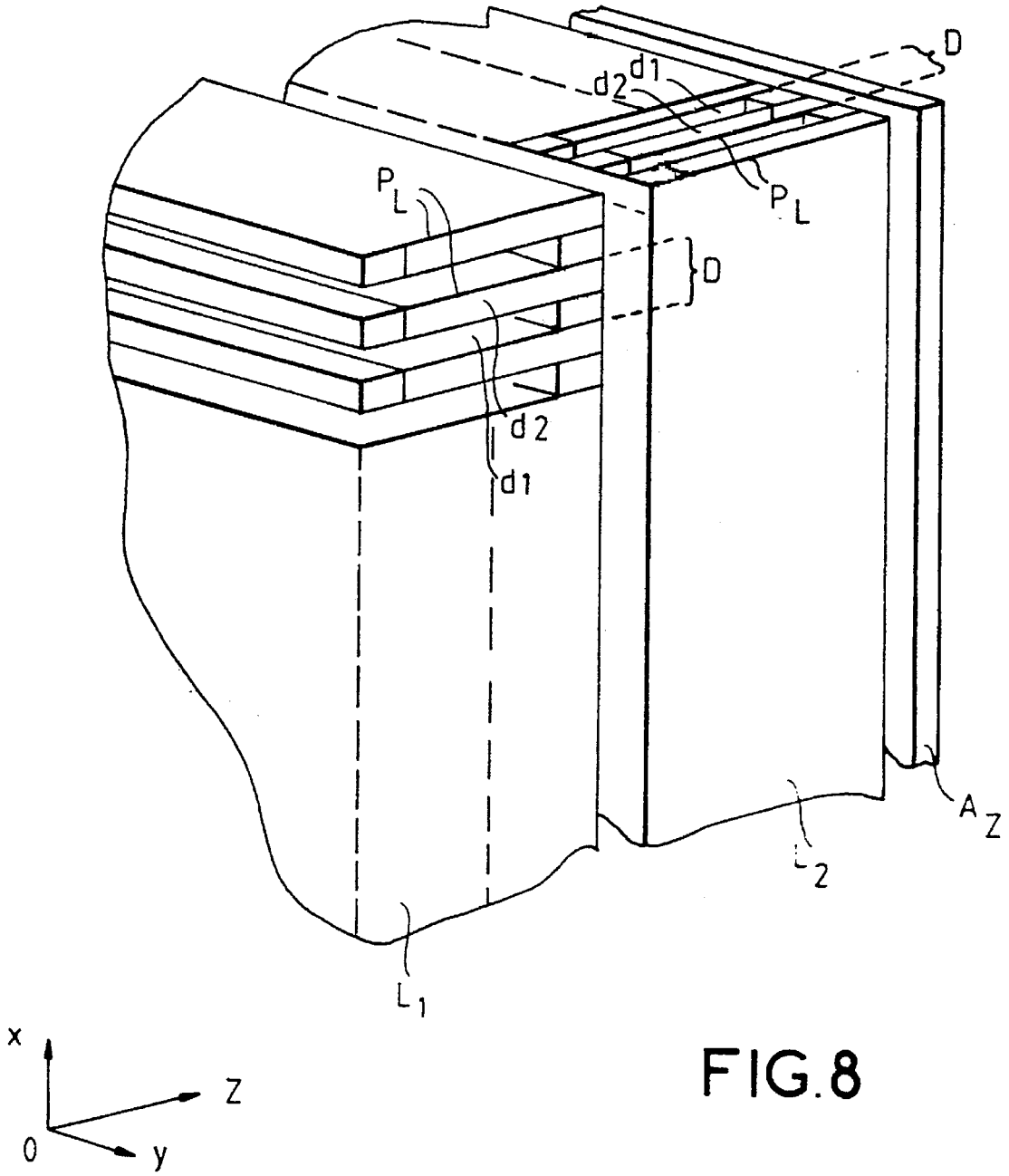
FIG. 8 shows another embodiment of the dual-polarization lens according to the invention, in which electronic scanning is accomplished in two perpendicular planes.

Referring to FIG. 8, another embodiment of the dual-polarization lens according to the present invention is shown, in which electronic scanning takes place in two perpendicular planes.

In this embodiment, the system is formed by two lenses $L_1$ and $L_2$ successively disposed in the direction OZ of propagation of the microwave energy. The first lens $L_1$ is constituted for example, as the lens L in FIG. 2, with its plates $P_L$ parallel to the plane of YOZ. The second lens $L_2$ is similar to the lens $L_1$ but rotated by 90° that is, its plates $P_L$ are parallel to the plane XOZ. In the embodiment shown in FIG. 7, the assembly further includes impedance matching means $A_Z$ disposed after the lens $L_2$. These comprise, for example, a dielectric plate which can typically be disposed at about $\lambda/4$ from the output side of the lens $L_2$ and have a thickness (along the axis OZ) of about $\lambda/2$ and a dielectric constant of about 3. In a variant of this embodiment, a matching dielectric plate similar to the plate $A_Z$ is also disposed between the two lenses $L_1$ and $L_2$. Such means are used to perfect the impedance match for the wave whose polarization is parallel to the channels. These means are, for example, formed by a susceptance which has an effect only on the desired wave.

There is thus implemented a phased-array antenna with scanning in two orthogonal planes and operating with two crossed polarizations.

What is claimed is:

1. A microwave lens for receiving electromagnetic waves propagating in a first direction, said lens including a plurality of phase-shifting channels stacked along a second direction substantially normal to said first direction, said channels being separated from one another by conductive plates substantially perpendicular to said second direction, each of said channels including a plurality of phase-shifting panels disposed substantially perpendicular to said first direction, each of said panels carrying conductive wires substantially parallel to said second direction, said wires carrying diodes, the control of the On or OFF state of said diodes of a panel varying the phase shift induced by the panel on said waves, each of said channels being divided into at least two subchannels by means of an intermediate conductive plate disposed between two said conductive plates and substantially parallel thereto, the distance between one intermediate conductive plate and one adjacent conductive plate being at most equal to the half-wavelength of said waves, said two subchannels being respectively assigned to two waves whose electric fields are orthogonal, each including a plurality of phase-shifting panels, and means for rotating by 90° the polarization of the incident wave.

2. A lens according to claim 1, wherein the first of said subchannels is assigned to the one of the received waves whose electric field is substantially normal to said conductive plates and intermediate conductive plate, and successively comprises along the path of said one of the received waves:

said phase-shifting panels;

first means for producing:

a 180°—phase shift of said wave, on command; and a 90°—rotation of the polarization of said wave.

3. A lens according to claim 2, wherein said first subchannel further comprises impedance matching means positioned along said path before said phase shifting panels.

4. A lens according to claim 1, wherein the second of said subchannels is assigned to that of said received waves whose electric field is substantially parallel to said conductive plates and said intermediate conductive plates and said phase shifting panels successively comprises along the path of said received wave:

second means for producing:

a 180°—phase shift of said wave, on command and, a 90°—rotation of the polarization of said wave.

5. A lens according to claim 4, wherein said second subchannel further comprises impedance matching means positioned along said path after said phase shifting panels.

6. A lens according to claim 3, wherein said first means comprise a filling dielectric material whose dielectric constant is selected to allow the propagation of a microwave whose electric fields is parallel to said plates, and, disposed in said filling material and successively along the path of said electromagnetic wave further comprises:

active means for rotating the polarization of an incident wave by substantially +45° or —45°, depending on the command it receives; and passive means for producing a 45° supplemental rotation of the polarization of the wave from said active means.

7. A lens according to claim 6, wherein said passive means comprise a first panel disposed substantially perpendicular to said first direction, said first panel including a first array of conductive wires substantially parallel to said second direction, said conductive wires being disposed with a pitch small as compared to said wavelength.

8. A lens according to claim 7, wherein said passive means further comprises a second panel disposed substantially parallel to said first panel and separated therefrom by said active means, said second panel including an array of conductive wires substantially parallel to a third direction normal to the first two directions, said conductive wires being disposed with a pitch small as compared to said wavelength.

9. A lens according to claim 6, wherein said active means include two array of wires each carrying diodes, the wires of the first array being disposed in a plane substantially perpendicular to said first direction, being substantially parallel to one another with a given pitch, forming with said second direction an angle substantially equal to +45°, and carrying diodes all connected in the same direction, the wires of the second array being disposed in a plane substantially perpendicular to said first direction, being substantially parallel to one another with the same given pitch, forming with a third direction perpendicular to said first two directions, an angle of substantially +45°, and carrying diodes all connected in the same direction.

10. A lens according to claims 3 or 5, wherein said second means are similar to said first means.

11. The lens according to claim 1 further comprising a means for transmitting and receiving two electromagnetic waves whose fields are orthogonal, disposed in the path of said phase shifting channels forming a phased array antenna.

12. The lens according to claim 11 further comprising a second lens disposed in line with said first lens, and parallel thereto, having an orientation 90° with respect to said first lens.

* * * * *